United States Patent [19]

Dauvergne

[11] 4,098,200

[45] Jul. 4, 1978

[54] LOW POLLUTION SOLID WASTE BURNER

[76] Inventor: Hector A. Dauvergne, 419 E. Merle Ct., San Leandro, Calif. 94577

[21] Appl. No.: 749,066

[22] Filed: Dec. 9, 1976

[51] Int. Cl.[2] ..... F23G 5/02; F23J 15/00

[52] U.S. Cl. ..... 110/204; 110/228; 110/215

[58] Field of Search ..... 110/8 R, 8 A, 8 P, 10, 110/15, 49 R, 72 R, 119

[56] References Cited

U.S. PATENT DOCUMENTS

| | | | |
|---|---|---|---|
| 3,403,643 | 10/1968 | Denig | 110/15 |
| 3,426,734 | 2/1969 | Rickard et al. | 110/49 |
| 3,515,078 | 6/1970 | Maitilasso | 110/15 |
| 3,538,865 | 11/1970 | Lausmann | 110/49 |
| 3,841,851 | 10/1974 | Kaiser | 110/8 |

*Primary Examiner*—Kenneth W. Sprague
*Attorney, Agent, or Firm*—Robert R. Tipton

[57] ABSTRACT

A low polluting solid waste burner utilizes a first combustion chamber in which the solid waste is partially oxidized under a positive pressure with the partially oxided gaseous combustion products passing out into a first conduit where the gas is recycled for dual burning back into the first combustion chamber. A conduit is also provided between the ash compartment and the combustion chamber to completely oxidize ash compartment gases with complete combustion product gases being conducted away to a spray tower or water curtain by the positive pressure in the combustion chamber produced by the combustion air blower. A second combustion chamber may be used to further oxidize the gaseous combustion products.

6 Claims, 2 Drawing Figures

LOW POLLUTION SOLID WASTE BURNER

BACKGROUND OF THE INVENTION

This invention relates to solid waste disposal systems and in particular to solid waste burners having a low pollution output.

All of the double combustion chamber solid waste burners of the prior art utilize the second combustion chamber as a means for complete oxidation of the volatile or partially oxidized gaseous combustion products from the first combustion chamber. Although they attempt to control combustion temperature in the first combustion chamber by regulation of combustion air only, no effort is generally used to maximize the utilization of heat of combustion of these volatile combustion products by recycling them through the first combustion chamber. In addition, little effort is made to recycle the volatile combustion product gases generated in the ash compartments of such devices.

SUMMARY OF THE INVENTION

The apparatus of the present invention utilizes a first combustion chamber having a combustion bed upon which the solid waste is burned under a positive pressure within the combustion chamber and with a conduit for directing gaseous combustion products out of the combustion chamber for recycling back into the first combustion chamber for dual burning proximate the combustion bed. A first air blower is used to create a positive pressure in the first combustion chamber and is used also to entrain the gaseous combustion products in the first conduit for recycling or dual burning back into the first combustion chamber. A conduit is provided between the ash compartment under the combustion chamber and the first conduit up-stream from the first air blower for recycling the ash compartment volatile gases through the combustion chamber, with the spent exhaust gases being conducted from a location immediately below the combustion bed to a location outside the system. A second air blower may be used to direct the combustion air which also entrains gaseous combustion products from the first conduit into a second conduit and finally into a second combustion chamber for complete oxidation of the partially oxidized gases.

A steam boiler with tubes depending into the combustion chamber further cools the gaseous combustion products and captures the heat of combustion for productive use.

A temperature sensor located in the first combustion chamber is connected to each of the blowers for control of the air flow into both combustion chambers and diversion of a portion of the combustion products into the second combustion chamber.

It is, therefor, an object of the present invention to provide an apparatus for low temperature complete combustion of solid waste products.

It is further object of the present invention to provide an apparatus for the combustion and disposal of solid waste products in which efficient use is made of the heat of combustion of the solid waste material.

It is still another object of the present invention to provide an apparatus for the combustion disposal of solid waste products in which the volatile combustion products from the first combustion chamber are divided, with a portion being recycled into the first combustion chamber and the second portion being oxidized in a second combustion chamber.

It is still a further object of the present invention to provide a solid waste disposal system in which the volatile combustion products from the ash compartment are recycled into the first combustion chamber.

It is a further object of the present invention to provide a solid waste disposal system in which a temperature monitor controls the amount of volatile materials from the first combustion chamber being recycled into said chamber.

It is still a further object of the present invention to provide a solid waste disposal system utilizing a flue gas detection system for control of the amount of gaseous nitrous compounds produced in the apparatus.

These and other object of the present invention will be manifest upon study of the following detailed description when taken together with the drawings.

DESCRIPTION OF THE PREFERRED EMBODIMENT

Figure 1:
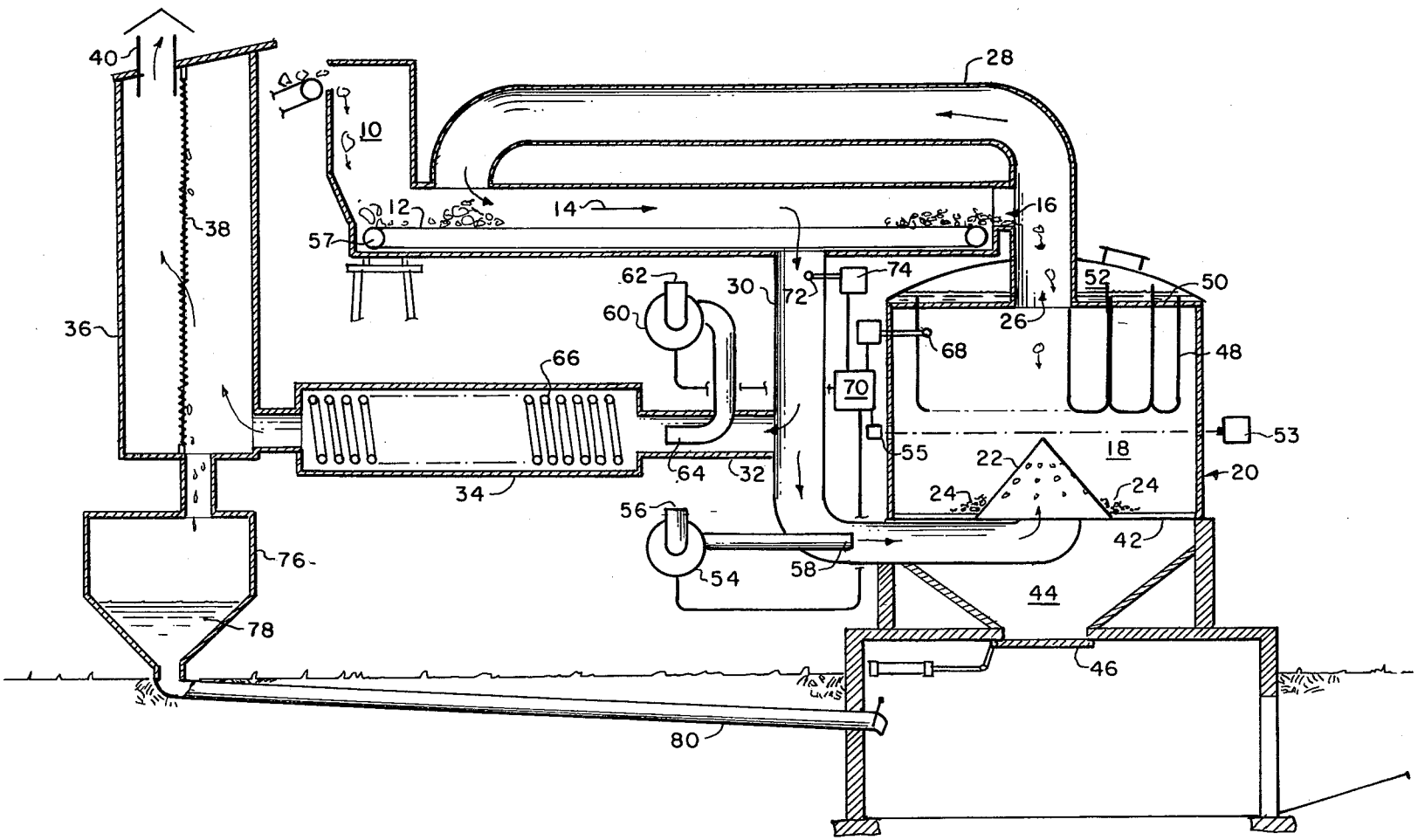
FIG. 1 is an elevation cross-section view of the complete low pollution solid waste disposal apparatus of the present invention.

With reference to FIG. 1, the apparatus of the present invention comprises, basically, a trash receiving hopper 10 which feeds incoming solid waste material on to conveyor 12 which which transports the material in the direction shown by arrow 14 over to trash feed entry port 16 where it drops down into combustion chambr 18 of first combustion member 20 falling on deflector cone 22 causing the material to spread out over combustion bed 24.

As the solid waste material is oxidized in combustion chamber 18, the volatile gaseous combustion products are directed up through gaseous combustion products exhaust port 26 passing into primary conduit 28 where they are directed to the front end of conveyor 12, down conveyor 12, to first conduit 30, thence down through conduit 30 where a portion of the gases are diverted through second conduit 32 into second combustion chamber 34 where they are completely oxided and thence out into scrubbing tower 36 where they pass through wet curtain 38 for removal of fly ash and sulfur dioxide gas after which they pass out to the atmosphere through stack 40.

With reference to conduit 30, although a portion of the gases are diverted through conduit 32, the remaining portion is recycled or directed back into first combustion chamber 18 for further oxidation in first combustion chamber 18 as well as introducing the volatile gases as a low temperature burning fuel to maintain and assure ignition of incoming solid waste material.

Combustion bed 24 comprises a grating 42 which allows the non-volatile solid combustion products to fall down into ash pit or collector 44 where they are held until clean-out is achieved by the operation of trap door 46.

The heat from the burning solid waste is collected by inverted U-shaped boiler tubes 48 depending from bottom plate 50. Bottom plate 50 forms the bottom portion of domed boiling water steam chamber 52. It should be noted that as the hot volatile gaseous combustion products flow up toward exit port 26, they pass through the plurality of inverted U-shaped boiler tubes 48 and heat the water therein. As hot spots form within combustion chamber 18, more particularly, in combustion bed 24, a group of tubes located proximate that area will individually evaporate a quantity of steam while others in a cooler section produce little of no steam. When the hot portion of the fire shifts to another area, the tubes will transfer roles. Since one end of the U-tubes begin in bottom shet 50 while the other end of the U-tubes extends above the boiling water surface, all steam is collected in boiler head 52 to achieve uniform cirulation and, therefore, cooling.

Combustion air is fed into first combustion chamber 18 to create a positive pressure therein by first air blower 54 having an intake port 56 and an exhaust nozzle 58. Exhaust nozzle 58 is arranged in conduit 30 pointing in the direction of combustion chamber 18 and having an outside diameter small than the inside diameter of conduit 30 such that the fresh air being blown into combustion chamber 18 also entrains a portion of the volatile combustion products contained in conduit 30.

Similarly, a second air blower 60 having an intake port 62 and an exhaust nozzle 64 is used to divert a portion of the volatile combustion products in conduit 30 through second conduit 32 to second combustion chamber 34. Exhaust nozzle 64 is arranged in conduit 32 pointing in the direction of combustion chamber 34 and having a diameter smaller than the inside diameter of conduit 32 whereby the volatile combustion products in conduit 30 are diverted into second combustion chamber 34 where the air supply from blower 60 is sufficient to completely oxidize the volatile gaseous combustion products. The heat from such combustion is collected by water contained in boiler tubes 66 within combustion chamber 34.

It can be seen that by adjusting the rate of air flow between first air blower 52 and second air blower 60, the total amount of air introduced into first combustion chamber 18 and second combustion chamber 34 can be controlled to create a positive pressure in combustion chamber 18 as well as the ratio of volatile combustion products passing through conduit 30 into chamber 18 and being diverted into conduit 32.

Such control is achieved through the use of temperature sensor 68 located within first combustion chamber 18 whose temperture measurement is detected by temperature monitor and control 70 which in turn controls the rate of air flow of first blower 54 and second blower 60.

A further control of air blowers 54 and 60 is achieved using flue gas detector 72 which monitors the gaseous nitrous compounds which are measured by flue gas monitor 74 whose output signal is also connected to monitor 70 for adjusting the rate of air flow to achieve minimum gaseous nitrous compounds in the flue gases. The temperature detector and control unit as well as the flue gas detector and control unit are not shown in detail since their circuits and design are well known in the art and the particulars of their construction do not form the novel portions of the present invention.

The rate of solid waste or trash feed is controlled by an optical beam system 51 comprising a light source 53 and a light detector 55 which is connected to a control unit or monitor 70. When the height of trash in combustion chamber 18 causes the optical beam to be blocked, control unit 70 regulates conveyor motor 57 to decrease the rate of flow of trash to combustion chamber 18. The rate of flow is increased, of course, when the trash material in chamber 18 no longer blocks the light beam from light source 53.

In operation, the solid waste converter of the present invention must consume a wide variety of waste materials with vastly different compositions and heating values without generating any signficant amount of air pollutants. This is accomplished by a carefully controlled combustion process which completely burns the fuel, e.g. solid waste material, in stages while maintaining temperatures below the fixation point of nitrogen (2500° F.).

The solid waste material is fed into the apparatus by the conveyor system 12, as previously noted, where it is dried by the volatile combustion flue gases existing from first combustion chamber 18 after passing through conduit 28. The feed rate of conveyor 12 is adjusted according to the combustion rate of solid waste material in combustion bed 24. This rate can be adjusted visually by observing the quantity of material in combustion bed 24 or by sensors previously described above.

The solid waste material, after being conveyed by conveyor 12 to feed port 16, drops into combustion chamber 18 through volatile gaseous combustion products exit port 26, as previously described, into combustion bed 24 where the primary combustion air is added from underneath cone 22 through conduit 30 from first air blower exhaust port 58.

The amount of air is carefully controlled so that it is a fraction of the stoichiometric amount, but sufficient for controlling combustion temperature, resulting in the formation of partially oxidized gases such as carbon monoxide (CO) and unburned hydrocarbons (HC). Temperature control is achieved through the use of temperature sensor 68 in combination with temperature control 70, as well as through flue gas monitor 74. The temperature is further controlled by the quenching of thefire on boiler tubes 48 and the walls of combustion chamber 18.

The hot volatile combustion gases containing CO and HC, then pass into conduit 28, then into conduit 30 where a portion of the gases are diverted into second combustion chamber 34 were additional air is provided by blower 60 which furnishes a greater than stoichiometric amount to complete the combustion process. Temperature is again controlled by quenching the fire in second combustion chamber 34 using boiler steam tubes 66.

Scrubbing tower 36 is used to control secondary emission of fly ash and particulates and simultaneously scrub any sulfur dioxide out of the remaining flue gas. Wet curtain 38 comprises a silicon treated curtain which is frame mounted vertically from the roof and water circulated down over the curtain. At the base of the curtain is a collection tank 76 where the treated water and the removed sludge are collected. The sludge is removed through a pipe 80 under the tank and the water is drawn off for recycling.

As the flue gases leave second combustion chamber 34, they pass into the scrubbing tower 36 where they then pass through wet curtain 38 to reach exhaust stack 40. As they pass through the porous curtain material, they come into contact with the water cascading down. The ash and particulates are thus scrubbed away and a calcium carbonate solution is used to remove the sulfur dioxide. The water can be chemically treated to recycle it for use in the scrubber.

Curtain 38 may contain a single layer of finely divided mesh for a particular system which has adequate pressure to drive the exhaust gases. However, it may also take the form of a multiple or multilayer curtain with a large mesh when the exhaust pressure is not as high. In either case the tower is constructed with a backwash system for intermittent cleaning of the tower curtain. This may comprise an array of sprayers that are directed that are directed onto the curtain to remove collected sludge by backflushing (not shown).

Figure 2:
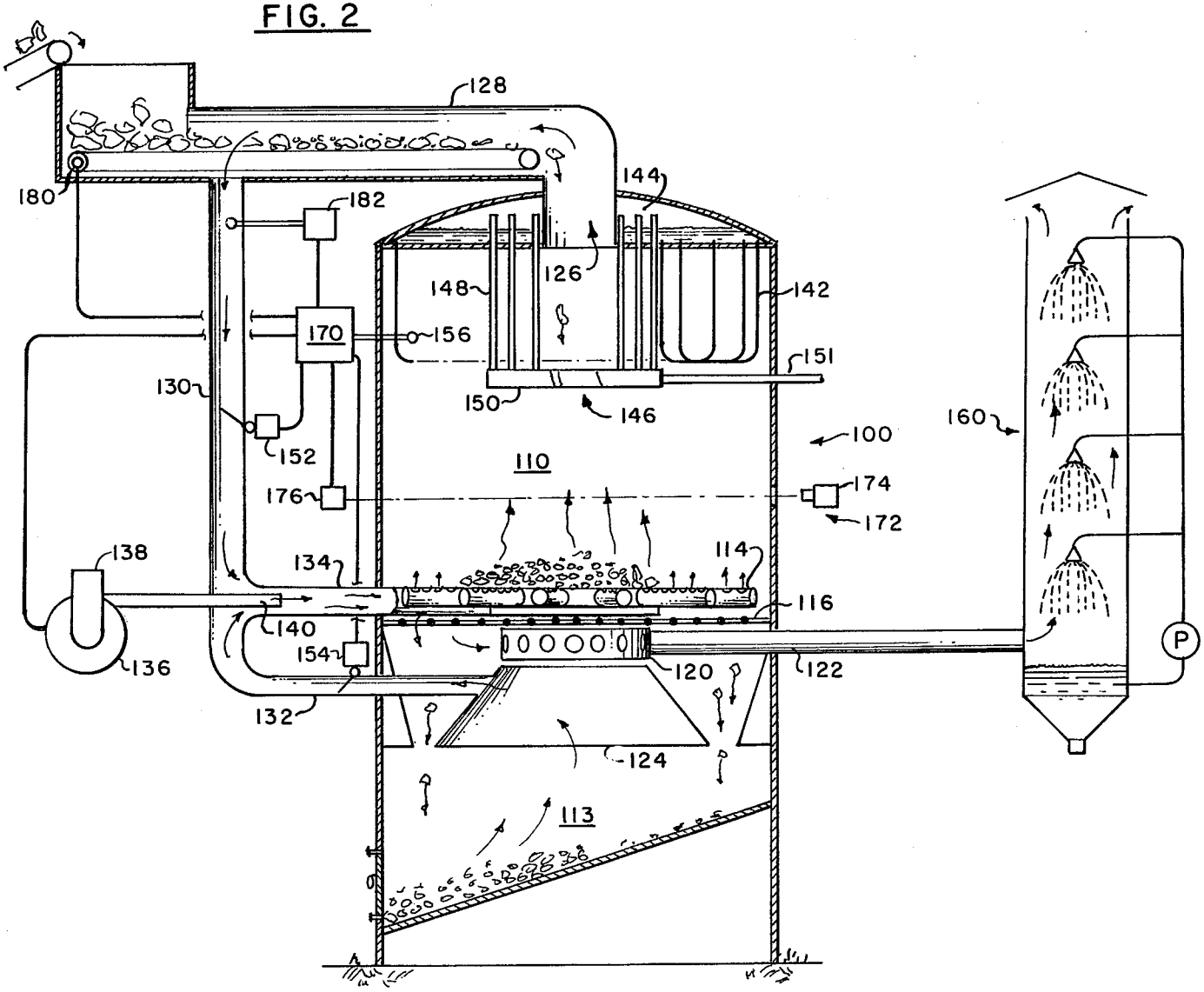
FIG. 2 is an elevational cross-sectional view of a further embodiment of the first combustion chamber of the present invention illustrating a further method of recycling the gaseous combusion products for greater efficiency.

With reference to FIG. 2, there is illustrated a further embodiment of the first combustion chamber of the present invention in which the later emitted volatile gaseous combustion products from the ash residue are recirculated into the combustion bed of the chamber.

In particular, with reference to FIG. 2, first combustion chamber assembly 100 comprises an upper combustion chamber 110 having a combustion bed 112, at the base of which is located a combustion air distribution head 114. Immediately below combustion air distribution head 114 is located a grill or grating 116 for support of large pieces of solid waste material. The smaller pieces of solid waste material which are burned or partially burned pass through grating 116 and drop into ash compartment 118 which is located below first combustion chamber 110. An exhaust gas collection head 120 is located immediately below grating 116 and is connected by exhaust gas conduit 122 to a scrubbing tower 160.

Immediately below exhaust gas collector head 120 is secondary volatile gaseous combustion products collector hood 124.

As is FIG. 1, the volatile gaseous combustion products from first combustion chamber 110 of FIG. 2 pass out of combustion chamber 110 through exit port 126 through conduit 128, preheating the incoming solid waste material, and then pass down through conduit 130 to meet with conduit 132 from hood 124 where the combined flow of gas is directed into conduit 134. An air blower 136, having an intake port 138 and an exhaust nozzle 140, is used to provide combustion air to first combustion chamber 110. Exhaust nozzle 140 is located within conduit 134, downstream from the point of connection of conduit 130 to conduit 132, and points in the direction of combustion chamber 110. Nozzle 140 has an outside diameter less than the inside diameter of conduit 134 such that the volatile gaseous combustion products from conduits 130 and 132 are entrained in the incoming air and are recycled through combustion chamber 110. Products and nitrous compounds in conduit 130 as measured by flue gas analyzer 182.

The feed rate of incoming trash is controlled by optical beam system 172 comprising a light source 174 and a detector 176 which is connected to control unit 170. When the trash level rises sufficiently to block the light beam 178, control unit 170 causes conveyor motor 180 to slow down or stop until the trash in combustion chamber 110 has burned down to a level below light beam 178.

For high volume trash feed into combustion chamber 20 (FIG. 1) or 100 (FIG. 2), a door or opening (not shown) can be made into the side wall of the chamber for access by a wide belt conveyor (not shown) used for conveying the solid waste through the opening. Hot combustion product gases from the combustion process can also be used to preheat and dry the incoming solid high volume solid waste.

In addition, dampers 152 and 154 are controlled by control unit 170 based on the temperature detected in combustion chamber 110 as measured by temperature sensor 156. Control of dampers 152 and 154 can also be controlled by the amount of volatile gaseous combustion The rate of flow of volatile combustion product gases from combustion chamber 110 is regulated by a motor driven damper 152 in conduit 130, while the rate of flow of volatile combustion product gases from ash compartment 118 is regulated by a motor driven damper 154 in conduit 132.

Quenching of the temperature in combustion chamber 110 is achieved through the assistance of U-shaped boiler tubes 142 used in conjunction with water-steam chamber 144 immediately above. In addition, steam is extracted from water-steam chamber 144 using steam collector assembly 146 which comprises steam collector tubes 148 whose ends are arranged above the water level of watersteam chamber 144 and which are connected to annular ring 150 which is in turn connected to conduit 152. which conducts steam outside of combustion chamber 110 for productive use.

It can be seen that through the use of annular ring 150 the steam passing down from chamber 144 is superheated by the flame action against ring 150 such that superheated steam is passed out through conduit 151.

In operation, it can be seen that as the solid waste material collects in combustion bed 112 and is oxidized by the incoming combustion air blown in by air blower 136, that the volatile and partially oxidized gaseous combustion products from chambers 110 and 118 are recirculated into combustion chamber 110 for further oxidation to obtain maximum efficient use of the heat of combustion of the solid waste material. In addition, the incoming air from blower 136 provides a positive pressure within combustion chamber 110 and and ash compartment 118 such that the remaining gases not collected by hood 124 are forced out through collector head 120 into conduit 122 and on to scrubbing tower 160. A secondary combustion chamber (not shown) may also be included in conduit 122 up-stream from scrubbing tower 160 thus providing complete low temperature combustion of the solid waste material.

I claim:

1. A disposal apparatus for solid waste comprising means defining a first combustion chamber, a combustion bed located in said first combustion chamber, means for conveying said solid waste to said combustion chamber, means defining a gaseous combustion products exhaust port located in said combustion chamber above said combustion bed, means defining a first conduit having one end connected to and in fluid communication with said gaseous combustion products exhaust port and having its other end in fluid communication with said combustion bed, and a first air blower having an intake port and an exhaust nozzle, said exhaust nozzle disposed in said first conduit, said exhaust nozzle arranged to blow air into said combustion bed with entrained gaseous combustion products in said first conduit, means defining a space below said combustion bed, means defining a second conduit having one end in fluid communication with said first conduit upstream from said exhaust nozzle and the other end in fluid communication with said space below said combustion bed.

2. A disposal apparatus for solid waste comprising means defining a first combustion chamber, a combustion bed located in said first combustion chamber, means for conveying solid waste to said combustion chamber and said combustion bed, a combustion air distribution head disposed proximate said combustion bed, means defining an ash compartment arranged below said combustion bed, means for collecting volatile gaseous combustion products emitted by ashes in said ash compartment, means for fluidly communicating volatile gaseous combustion products from said first combustion chamber and said means for collecting volatile gaseous combustion products in said ash compartment to said combustion air distribution head, means for providing combustion air to said combustion air distribution head, and an exhaust gas collector head located between said combustion air distribution head and said means for collecting volatile gaseous combustion products in said ash compartment, said exhaust gas collection head being in fluid communication with the exterior atmosphere.

3. The disposal apparatus as claimed in claim 2 wherein said means for providing combustion air to said combustion air distribution head comprises a conduit fluidly communicating said first combustion chamber and said ash compartment with said combustion air distribution head, and an air blower having an intake port and an exhaust nozzle, said exhaust nozzle located in said conduit and having an outside diameter less than the inside diameter of said conduit and pointing in the direction of flow toward said combustion air distribution head, whereby said volatile gaseous combustion products are entrained in the air flowing from said nozzle to said combustion air distribution head.

4. The disposal apparatus as claimed in claim 2, further comprising means defining a water and stream chamber disposed above said first combustion chamber having a bottom plate and a dome cover, a plurality of U-shaped boiler tubes in fluid communication with said water and steam chamber and depending downwardly from said bottom plate, a plurality of steam collection tubes having one end located above the water in said water and steam chamber, a steam collection chamber located in said first combustion chamber below said U-shaped boiler tubes and connected to the other end of said steam collection tubes in fluid communication with said steam and water chamber, and means for transporting steam from said steam collection chamber to the exterior of said first combustion chamber.

5. The apparatus as claimed in claim 1 further comprising means defining an ash compartment located below said combustion bed, a gas collector hood located in said ash compartment proximate the upper region thereof and below said combustion bed, a third conduit having one end connected to said gas collector hood and in fluid communication with said ash collector, and having its other end connected to and in fluid communication with said first conduit up-stream from said first blower exhaust nozzle, and means for conveying exhaust gases out of said combustion chamber having an inlet end and outlet end, said inlet end located between said combustion bed and said gas collector hood.

6. The apparatus as claimed in claim 5 further comprising means for measuring nitrous compounds in said gaseous combustion products, and means for changing the rate of gas flow in said first conduit and said third conduit is accordance with the nitrous compounds contained in said gaseous combustion products measured by said means for measuring nitrous compounds.

* * * * *